US006205923B1

(12) United States Patent
Dawley et al.

(10) Patent No.: US 6,205,923 B1
(45) Date of Patent: Mar. 27, 2001

(54) APPARATUS FOR REDUCING PROCESSION OF A PRINTING BLANKET

(75) Inventors: Douglas Joseph Dawley, Epping; James Brian Vrotacoe, Rochester, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 08/472,354

(22) Filed: Jun. 7, 1995

Related U.S. Application Data

(63) Continuation of application No. 08/007,453, filed on Jan. 22, 1993, now abandoned.

(51) Int. Cl.[7] ..... B41F 27/00; B41F 13/00; B41F 5/16; B41F 5/18

(52) U.S. Cl. ..... 101/382.1; 101/375; 101/177; 101/217; 101/142

(58) Field of Search ..... 101/217–219, 101/177, 137, 142, 143, 395, 396, 154, 375, 376, 368, 378, 379, 382.1, 383, 389.1, 401.1, 479

(56) References Cited

U.S. PATENT DOCUMENTS

| | | | | |
|---|---|---|---|---|
| 4,030,415 | * | 6/1977 | Fellows | 101/389.1 |
| 4,056,057 | * | 11/1977 | Smith | 101/389.1 |
| 4,144,813 | | 3/1979 | Julian . | |
| 4,332,194 | * | 6/1982 | Gensheimer et al. | 101/216 |
| 4,589,339 | * | 5/1986 | Fischer | 101/217 |
| 4,913,048 | * | 4/1990 | Tittgemeyer | 101/375 X |
| 5,245,923 | * | 9/1993 | Vrotacoe | 101/375 X |

FOREIGN PATENT DOCUMENTS

| | | |
|---|---|---|
| 8532300 U | 2/1986 | (DE) . |
| 1 401 695 | 7/1973 | (GB) . |

OTHER PUBLICATIONS

Patent Abstracts of Japan vol. 17 No. 106.

* cited by examiner

*Primary Examiner*—Kimberly Asher
(74) *Attorney, Agent, or Firm*—Kenton & Kenyon

(57) ABSTRACT

An apparatus for reducing procession of a gapless tubular printing blanket in an offset printing press caused by at least one fluid wave having a certain pressure trapped at an interface of the printing blanket and a blanket cylinder. The apparatus includes a blanket cylinder which is adapted to receive the printing blanket for mounting on its circumferential surface. The blanket cylinder has at least one path which connects an interface of the blanket cylinder and the printing blanket to a region of pressure lower than the pressure in the fluid wave. The path allows the fluid wave, which is trapped at the interface and advancing in front of a nip between the blanket cylinder and an adjacent cylinder, to escape to the region of low pressure.

6 Claims, 8 Drawing Sheets

APPARATUS FOR REDUCING PROCESSION OF A PRINTING BLANKET

This application is a continuation of application Ser. No. 08/007,453, filed on Jan. 22, 1993, now abandoned.

FIELD OF THE INVENTION

The present invention relates to offset printing presses and more particularly to an apparatus for reducing procession of a gapless tubular printing blanket mounted on a blanket cylinder.

BACKGROUND OF THE INVENTION

In offset printing, printed images are transferred from printing plates mounted on plate cylinders to a moving web of material by transfer cylinders known as blanket cylinders. Typically, printing blankets are mounted on the blanket cylinders which have a rubber surface for transferring the printed images. Conventional printing blankets are rectangular in shape and mounted in axial gaps extending across the circumferential surface of the blanket cylinders. One problem with this design is that at high operational speeds the gap in the blanket cylinder causes vibrations in the printing press which have the effect of varying the optical densities of the printed image. There are a number of other problems associated with this design which affects the quality of the final printed product.

Many of these problems have been solved by making the printing blankets gapless and tubular in shape. However, this improved design has created several problems of its own.

To mount the tubular printing blankets, an air canal is provided at one end of the blanket cylinder. The canal supplies pressurized air radially outward through a plurality of passages. As a printing blanket is placed over the passages, the pressure from the exiting air radially expands the printing blanket enabling it to be axially mounted onto the circumferential surface of the blanket cylinder. Since the inner circumference of the printing blanket is slightly smaller than the outer circumference of the blanket cylinder, once the printing blanket is mounted it is stressed in tension by the blanket cylinder to provide a tight pressure relationship between the printing blanket and the blanket cylinder. This pressure relationship fixes the printing blanket on the blanket cylinder so that there is no relative movement therebetween during operation of the press.

A problem with this arrangement is that air gets trapped at the interface of the printing blanket and the blanket cylinder. During operation of the press this trapped air creates a continually advancing wave in front of a nip between the blanket cylinder and the cylinder against which it is pressed causing the printing blanket to bulge. This phenomena is known as printing blanket procession. It creates defects in the printed product by forming latent double images.

Several attempts have been made to reduce or eliminate blanket procession, but none have been successful. One attempted solution was to increase interference between the printing blanket and the blanket cylinder. Another was to change the material combination of the printing blanket and the blanket cylinder surface to a combination having higher coefficients of friction. Both of these attempted solutions failed, since the primary cause of procession does not involve slippage of the printing blanket relative to the blanket cylinder.

Another attempted solution was to decrease the normal forces between the blanket cylinder and its adjacent cylinders, i.e., the printing cylinder and impression cylinder or other blanket cylinder. Although this solution reduces the rate of procession, it also reduces the quality of print to an unacceptable level. Still another solution was attempted which involved mechanically fixing the printing blanket to the blanket cylinder. This attempt was also unsuccessful because the printing blanket was too thin to withstand the forces required to stop the procession, and hence the printing blanket would tear.

The deficiencies in each of these attempts are fundamental and cannot be eliminated.

OBJECTS AND SUMMARY OF THE INVENTION

An object of the present invention is to provide an apparatus that removes the fluid wave that causes printing blanket procession.

The present invention provides an apparatus for reducing procession of a gapless tubular printing blanket in an offset printing press caused by at least one advancing fluid wave having a certain pressure, comprising: a blanket cylinder adapted to receive the printing blanket for mounting on its circumferential surface; and means for connecting an interface of the blanket cylinder and the printing blanket to a region of pressure lower than the pressure in the fluid wave to allow the fluid wave, which is trapped at the interface and advancing in front of a nip between the blanket cylinder and an adjacent cylinder, to escape to the region of low pressure.

In one embodiment of the present invention, the means for connecting the interface of the blanket cylinder and the printing blanket to a region of low pressure comprises the blanket cylinder having at least one groove extending along its circumferential surface, the trapped fluid wave escaping via the groove.

In another embodiment of the present invention, the means for connecting the interface of the blanket cylinder and the printing blanket to a region of low pressure comprises the printing blanket having at least one groove extending along its inner circumferential surface, the trapped fluid wave escaping via the groove.

In a further embodiment of the present invention, the means for connecting the interface of the blanket cylinder and the printing blanket to a region of low pressure comprises a plurality of small granular particles having spaces formed therebetween, the trapped fluid wave escaping via the spaces.

An advantage of the present invention is that it removes the trapped fluid wave that causes procession of the printing blanket without reducing the quality of the final printed product.

Another advantage of the present invention is that it eliminates latent double images and hence improves the overall quality of the final printed product.

A further advantage of the present invention is that it removes the trapped fluid wave within several rotations of the blanket cylinder so that the printing operation may proceed almost immediately after mounting the printing blanket.

These and other objects, characteristics, and advantages of the present invention will become apparent in view of the description and accompanying drawings that follow.

DETAILED DESCRIPTION

Figure 1:
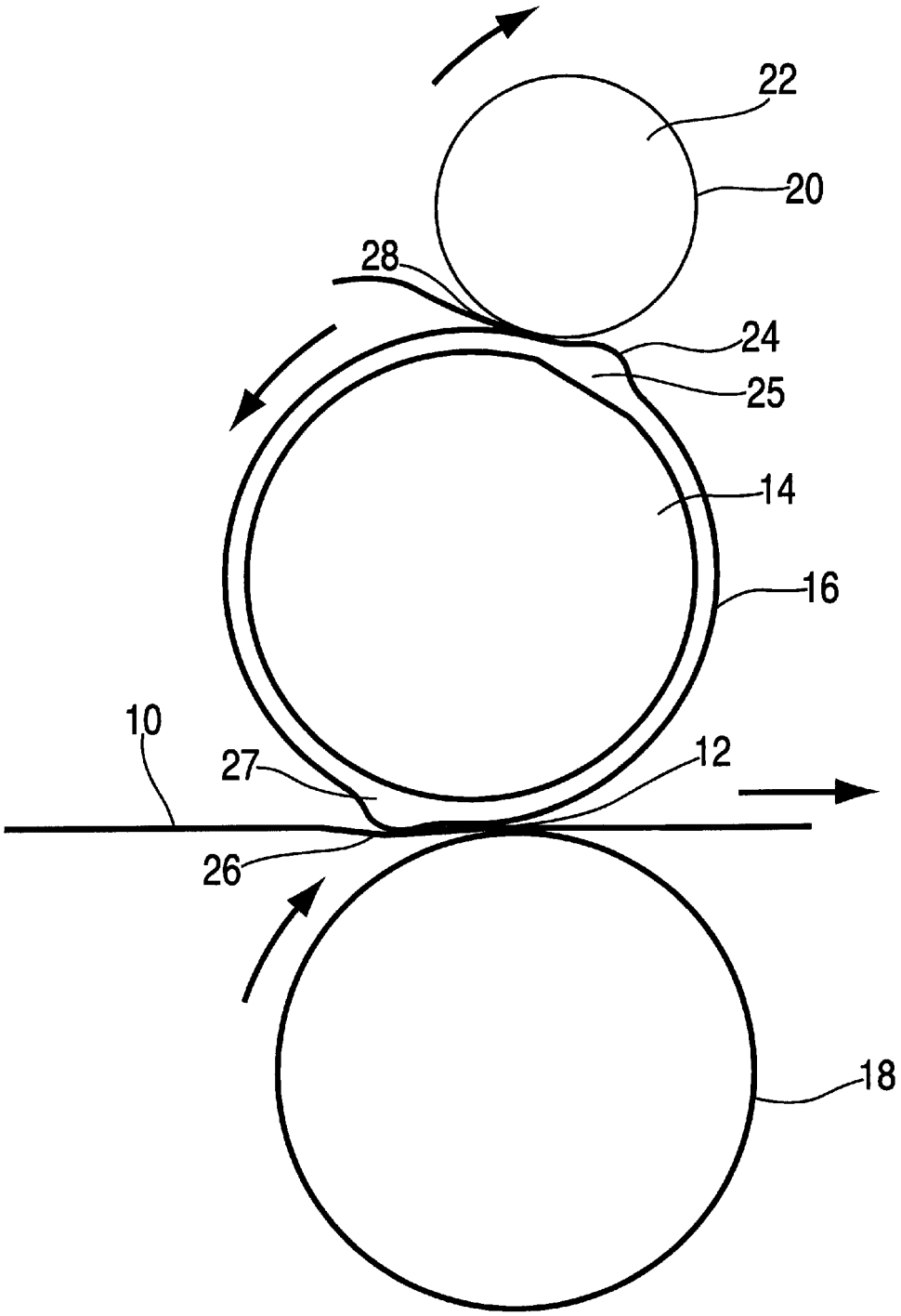
FIG. 1 (Prior Art)
FIG. 1 is a representational side view of a prior art offset printing press showing procession of a printing blanket caused by fluid waves, trapped at the interface of a blanket cylinder and the printing blanket mounted thereon, advancing in front of nips between the blanket cylinder and a plate cylinder and the blanket cylinder and an impression cylinder.

FIG. 1 shows a web material 10 passing through a nip 12 between a blanket cylinder 14, having a gapless tubular printing blanket 16 mounted thereon, and an impression cylinder 18 in an offset printing press. It should be understood that to achieve printing on both sides of the web material 10, the impression cylinder 18 could be replaced by another blanket cylinder having a printing blanket mounted thereon. The printing blanket 16 transfers printed images from a printing plate 20 mounted on a plate cylinder 22 to the web material 10.

During operation of the printing press, bulges 24 and 26 form in the printing blanket 16. They are caused by fluid waves 25 and 27 advancing in front of nips 28 and 12 between the blanket cylinder 14 and the plate cylinder 22 and between the blanket cylinder 14 and the impression cylinder 18, respectively. The fluid waves 25 and 27 are created by air trapped during mounting of the printing blanket 16 onto the blanket cylinder 14. This trapped air has a pressure that creates the bulges 24 and 26 in front of the nips 28 and 12.

Figure 2:
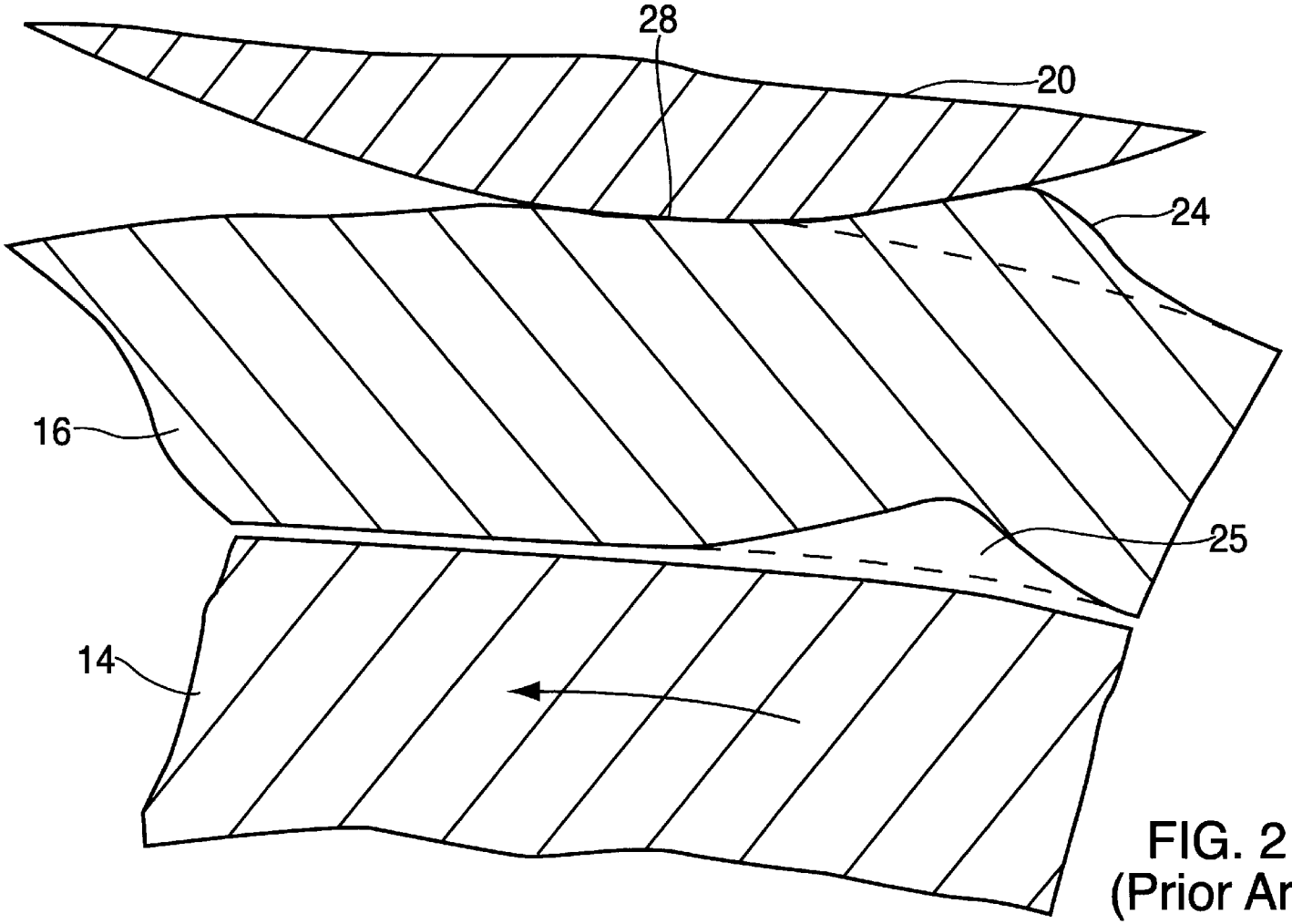
FIG. 2 (Prior Art)
FIG. 2 is an exploded view of the fluid wave advancing in front of the nip between the blanket cylinder and the plate cylinder of FIG. 1 and the bulge it creates in the printing blanket.

The effect of the fluid wave 25 will now be described with reference to FIG. 2. The fluid wave 25 advances continuously around the blanket cylinder 14 causing the printing blanket 16 to move relative to the blanket cylinder with each revolution. This motion causes the image transferred onto the printing blanket 16 to be in a different position relative to printing plate 20 every revolution. The distance between any given image transferred onto the printing blanket 16 and a previous revolution's latent image imprinted on the printing blanket causes two images to be printed on the web material 10, i.e., a double image. This double image is an undesirable printing defect.

By removing the fluid wave 25, and similarly the fluid wave 27, any relative motion between the printing blanket 16 and blanket cylinder 14 is virtually undetectable and does not cause a printing defect.

The present invention is directed to an apparatus for removing the fluid waves 25 and 27 that create the bulges 24 and 26. Generally speaking, it provides a path along which the advancing fluid waves (trapped air) can escape from beneath the printing blanket 16. It is contemplated that the system for removing the trapped fluid which constitutes the present invention can utilize any geometry that will allow the fluid to flow from an interface of the printing blanket 16 and the blanket cylinder 14 to an area of pressure lower than the hydrodynamic pressure in the fluid waves 25 and 27.

Figure 3:
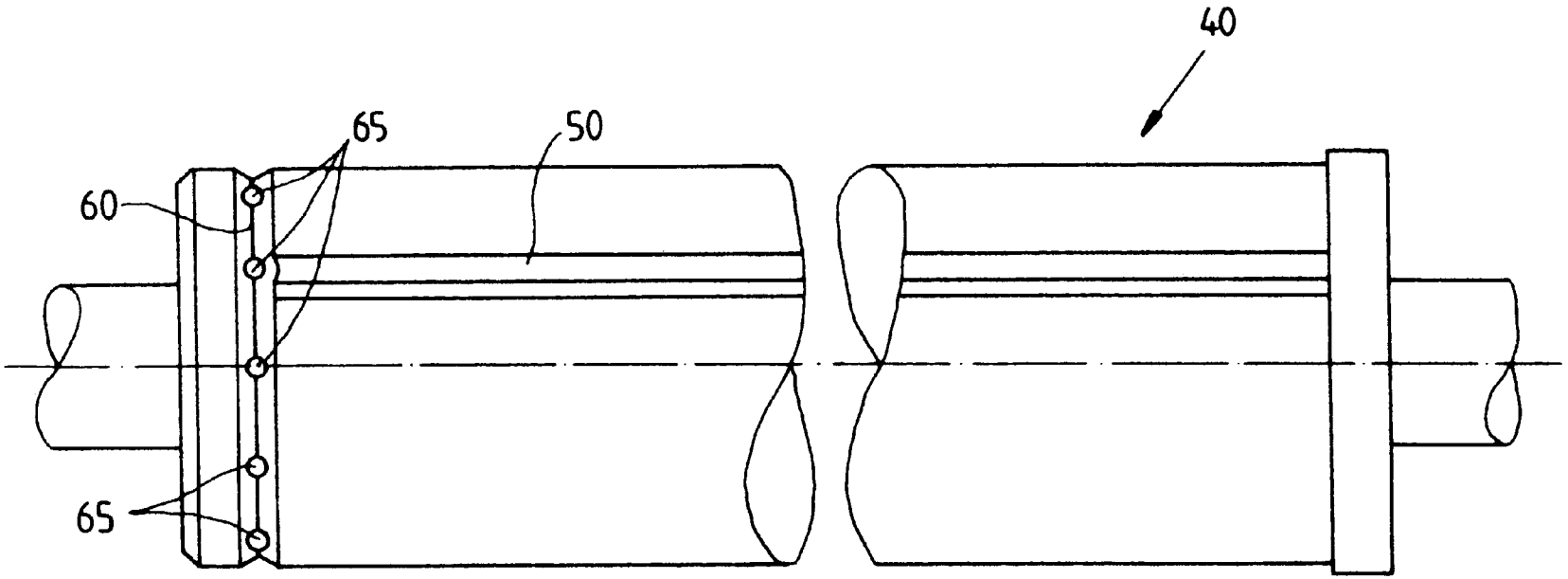
FIG. 3 is a perspective view of one embodiment of the present invention showing a blanket cylinder having a groove extending straight across its circumferential surface.

One embodiment of the present invention provides a blanket cylinder having at least one groove of any orientation. FIG. 3 shows one such arrangement wherein a blanket cylinder 40 is provided which has a groove 50 extending straight across the circumferential surface of the blanket cylinder. The groove 50 connects the interface of the blanket cylinder 40 and a printing blanket (not shown) mounted thereon to an air canal 60. The air canal 60 supplies pressurized air through passages 65 to radially expand the printing blanket so that it can be mounted onto the blanket cylinder 40. However, during operation of the printing press, the air canal 60 can be vented to the atmosphere so that the fluid waves can escape to a region of low pressure via the groove 50.

Figure 4:
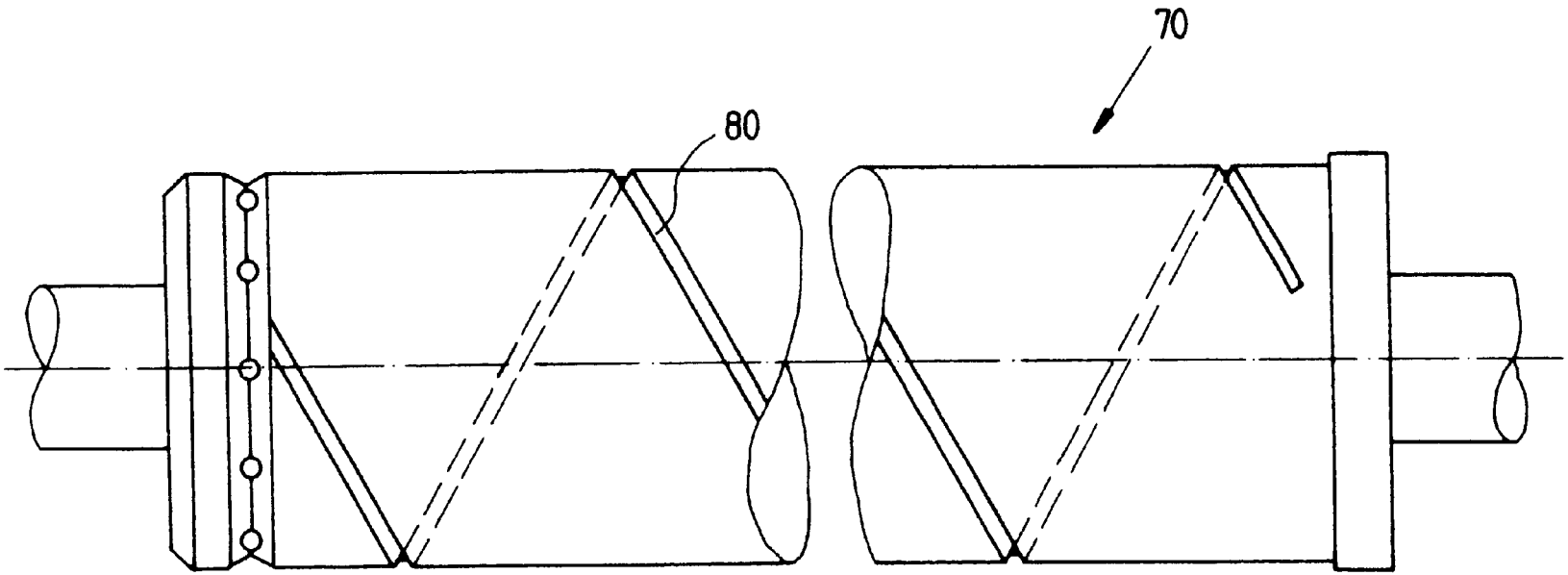
FIG. 4 is a perspective view of another embodiment of the present invention showing a blanket cylinder having a groove extending helically around and across the circumferential surface of the blanket cylinder.

FIG. 4 shows a related embodiment wherein a blanket cylinder 70 is provided which has a groove 80 extending helically around and across the circumferential surface of the blanket cylinder. Although FIGS. 3 and 4 show a single straight groove and a single helical groove, a plurality of such grooves may be provided which may or may not interconnect with one another. Furthermore, the present invention is not limited to these configurations. The grooves 50 and 80 may be of any geometrical configuration and have any cross-section.

Figure 5:
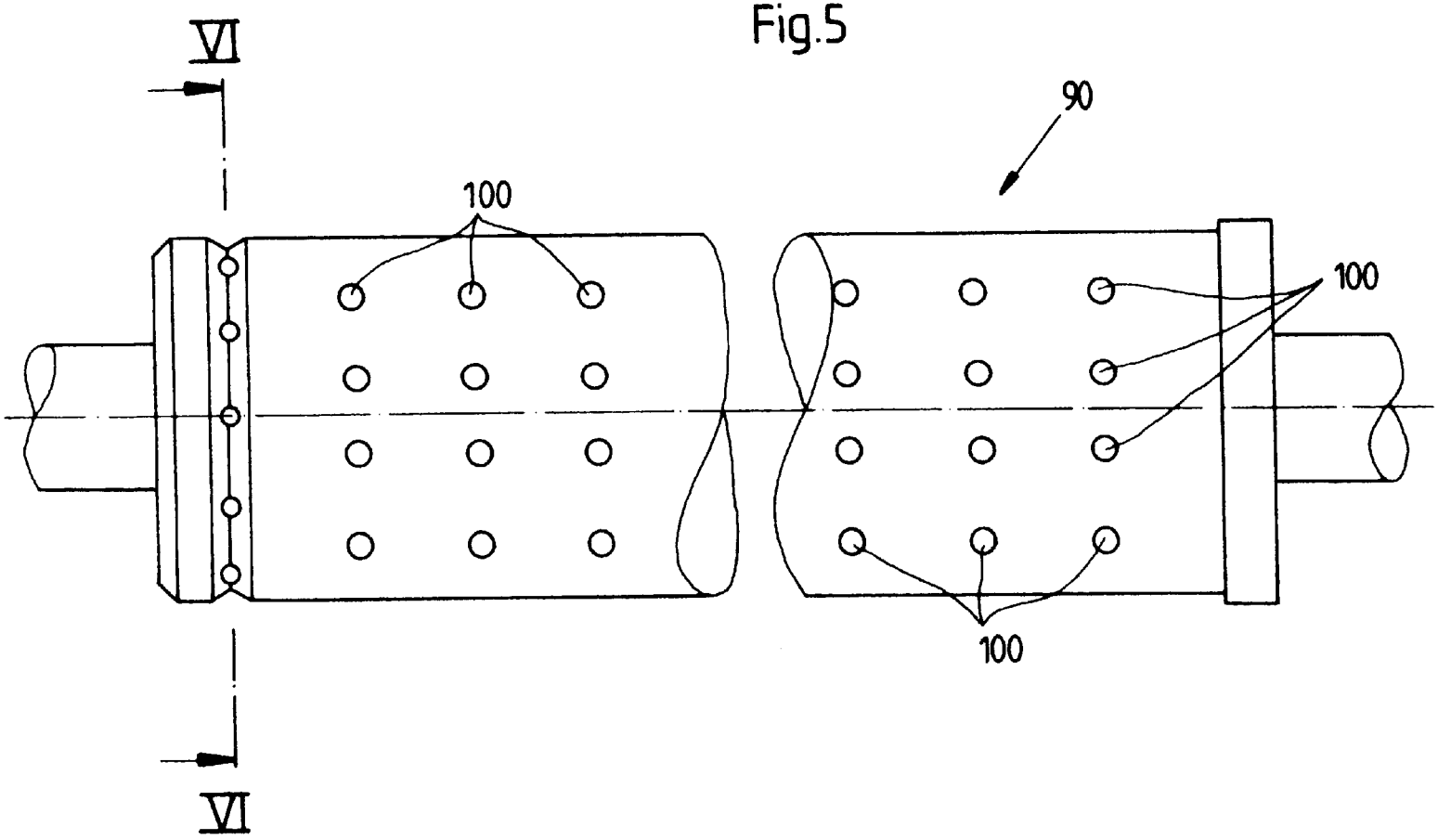
FIG. 5 is a perspective view of another embodiment of the present invention showing a blanket cylinder having a plurality of discrete holes disposed on its circumferential surface.

Another embodiment of the present invention is shown in FIG. 5 wherein a blanket cylinder 90 has a plurality of discrete holes 100 which connect an interface of the blanket cylinder 90 and a printing blanket 105 (shown in FIG. 6) mounted thereon to a region of low pressure.

Figure 6:
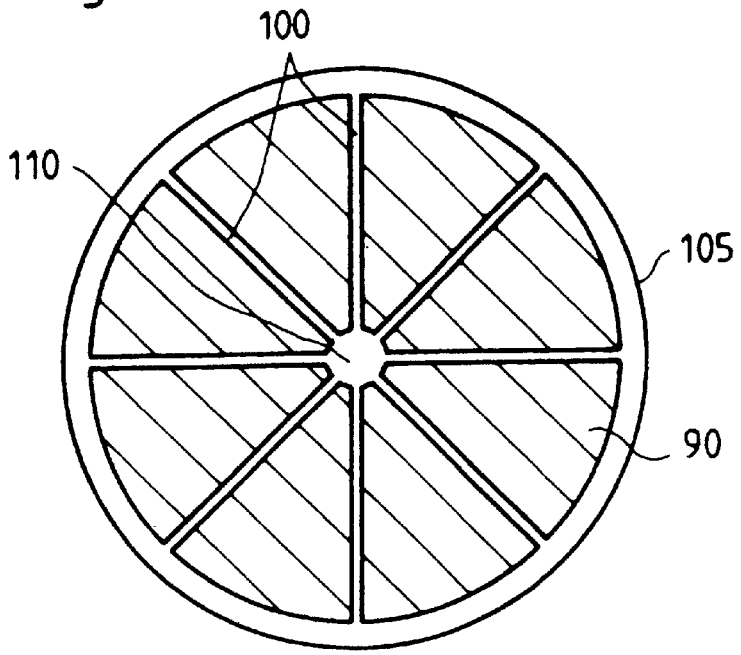
FIG. 6 is a side view of the blanket cylinder of FIG. 5 showing the holes leading from the circumferential surface of the blanket cylinder to a channel.

FIG. 6 shows the plurality of holes 100 leading from the circumferential surface of the blanket cylinder 90 leading into a channel 110 which feeds into an air canal (not shown) which, as with the embodiments in FIGS. 3 and 4, vents to the atmosphere during operation of the printing press. This embodiment is not limited to the arrangement shown in FIGS. 5 and 6. Rather, any arrangement of holes may be used and the holes may be of any geometrical configuration.

Figure 7:
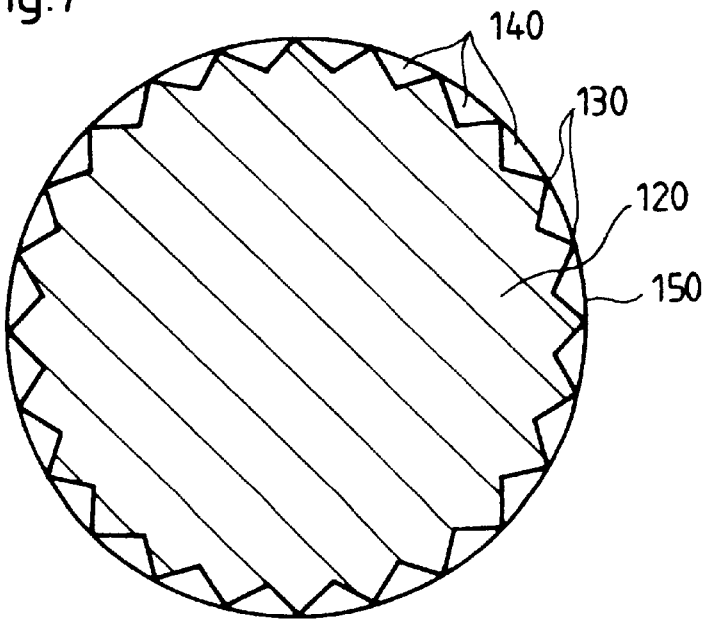
FIG. 7 is a side view of a further embodiment of the present invention showing a blanket cylinder having a rough circumferential surface, the contour of which is defined by peaks and valleys.

FIG. 7 shows still another embodiment of the present invention. In this embodiment, a blanket cylinder 120 is provided which has a rough circumferential surface, the contour of which is defined by peaks 130 and valleys 140. The peaks 130 and valleys 140 may be formed by a plurality of knurls. The valleys 140 connect the interface of the blanket cylinder 120 and a printing blanket 150 mounted thereon to a region of pressure lower than that of the advancing fluid wave. The printing blanket 150 rides the peaks 130 allowing the trapped fluid waves to escape via the valleys 140.

Figure 8:
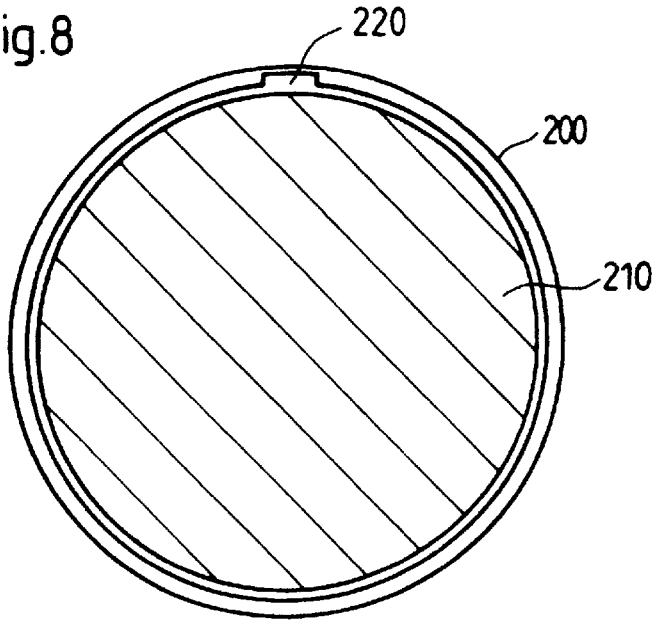
FIG. 8 is a side view of a further embodiment of the present invention showing a tubular gapless printing blanket having a groove extending along its inner circumferential surface.

FIG. 8 shows an other embodiment of the present invention. In this embodiment, a tubular gapless printing blanket 200 is provided which is mounted on a blanket cylinder 210. The printing blanket 200 has a groove 220 extending along its inner circumferential surface. The groove 220 connects the interface of the printing blanket 200 and the blanket cylinder 210 to a region of low pressure providing a path along which the trapped fluid waves can escape. As with the grooves 50 and 60 in the embodiments shown in FIGS. 3 and 4, the groove 220 may be of any geometrical configuration and have any cross-section. Furthermore, a plurality of such grooves may be provided which may or may not interconnect with one another. The inner circumferential surface of the printing blanket 200 may also have a rough contour defined by peaks and valleys, wherein the trapped fluid waves escape via the valleys.

Figure 9:
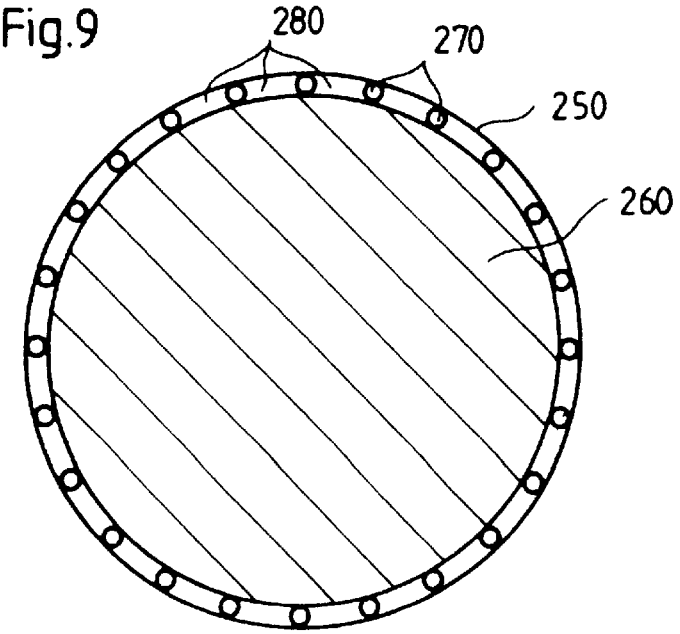
FIG. 9 is a side view of another embodiment of the present invention showing a plurality of small granular particles at the interface of a blanket cylinder and printing blanket mounted thereon.
Figure 9A:
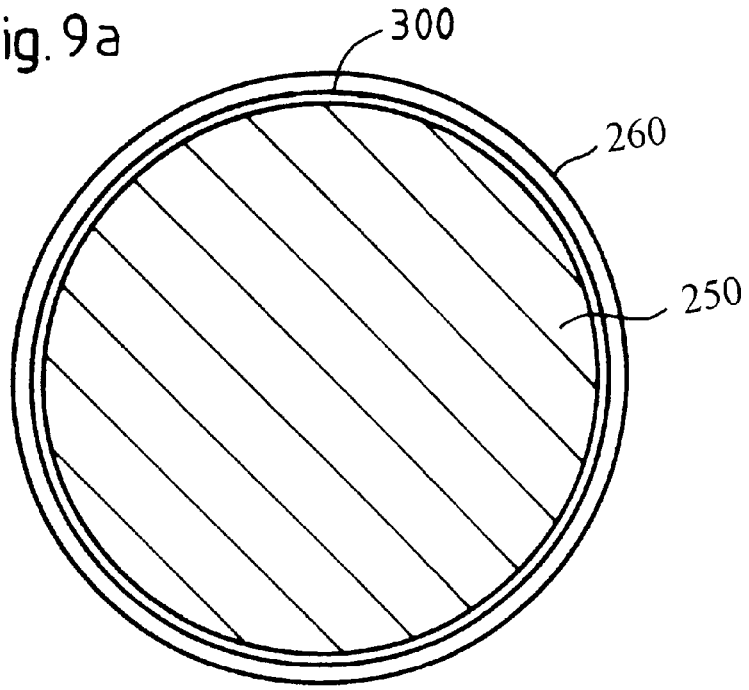

FIG. 9 shows still another embodiment of the present invention wherein a tubular gapless printing blanket 250 is provided which is mounted on a blanket cylinder 260. In this embodiment, a foreign substance, e.g., small granular particles 270 such as talc, is introduced at the interface of the printing blanket 250 and the blanket cylinder 260. The printing blanket 250 rides on the small granular particles 270 allowing the trapped fluid to escape via spaces 280 formed between the particles to a region of low pressure. The small granular particles 270 may be of any geometric configuration such that the spaces 280 formed between the particles allow the trapped fluid to escape to the region of low pressure.

It is to be understood that for each embodiment described herein, the region to which the trapped fluid flows could be the atmosphere, a generated vacuum, or any other region with a pressure lower than that of the advancing fluid waves.

While the present invention is capable of various modifications and alternate constructions, it is not intended to limit the invention to the specific embodiments disclosed herein. Rather, it is intended to cover all modifications and alternative constructions falling within the spirit and scope of the invention as expressed in the claims.

What is claimed is:

1. An apparatus for reducing procession of a gapless tubular printing blanket in an offset printing press caused by at least one advancing fluid wave having a certain pressure, comprising:

a gapless tubular printing blanket having an inner circumference;

a blanket cylinder having a circumferential surface and having an outer circumference which is greater than the inner circumference of the printing blanket, said circumferential surface adapted to receive the gapless tubular printing blanket for mounting thereon, means for radially expanding the gapless tubular printing blanket during installation of the printing blanket onto and removal of the printing blanket from the blanket cylinder;

a print cylinder in rolling engagement with the blanket cylinder; and means extending axially across a length of the blanket cylinder circumferential surface, for connecting an interface of the blanket cylinder and the printing blanket to a low pressure region, said interface enclosing a fluid wave between the blanket cylinder and the printing blanket, said low pressure region having a pressure lower than the pressure at the interface, said connecting means thereby allowing the fluid wave in the interface to escape to the low pressure region.

2. The apparatus according to claim 1, wherein the connecting means comprises at least one groove extending substantially across a length of the circumferential surface of the blanket cylinder, the trapped fluid wave escaping via the groove.

3. The apparatus according to claim 2, wherein the at least one groove extends axially across the length of the circumferential surface of the blanket cylinder.

4. The apparatus according to claim 1, wherein the connecting means comprises a plurality of grooves extending substantially across a length of the circumferential surface of the blanket cylinder, the trapped fluid wave escaping via the grooves.

5. The apparatus according to claim 4, wherein the plurality of grooves are independent of each other.

6. The apparatus according to claim 4, wherein the plurality of grooves are interconnected to each other.

* * * * *